United States Patent [19]

Fuchs

[11] Patent Number: 4,934,568

[45] Date of Patent: Jun. 19, 1990

[54] DISCHARGER FOR FLOWABLE MEDIA

[75] Inventor: Karl-Heinz Fuchs, Radolfzell, Fed. Rep. of Germany

[73] Assignee: Ing. Erich Pfeiffer GmbH & Co. KG, Fed. Rep. of Germany

[21] Appl. No.: 296,895

[22] Filed: Jan. 12, 1989

Related U.S. Application Data

[63] Continuation of Ser. No. 22,792, Mar. 6, 1987, abandoned.

[30] Foreign Application Priority Data

Dec. 19, 1985 [DE] Fed. Rep. of Germany ..... 3544985

[51] Int. Cl.[5] ..... B67D 5/32

[52] U.S. Cl. ..... 222/153; 251/115; 222/321; 222/402.11

[58] Field of Search ..... 222/153, 321, 402.11; 251/115

[56] References Cited

U.S. PATENT DOCUMENTS

| | | | |
|---|---|---|---|
| 3,169,672 | 2/1965 | Soffer et al. | 222/402.11 |
| 3,446,406 | 5/1969 | Trott | 222/507 |
| 3,591,128 | 7/1971 | Ranis | 222/402.11 |
| 3,729,119 | 4/1973 | Sette et al. | 222/153 |
| 3,738,537 | 6/1973 | Gach | 222/402.11 |
| 3,828,982 | 8/1974 | Steigerwald | 222/153 |
| 3,885,717 | 5/1975 | Ewald | 222/402.11 |
| 3,894,665 | 7/1975 | Swenson | 222/402 |
| 3,940,023 | 2/1976 | Unstead | 222/402.11 |
| 4,024,995 | 5/1977 | Landen et al. | 222/402 |
| 4,113,445 | 9/1978 | Meshberg | 222/321 |
| 4,346,821 | 8/1982 | Wesner et al. | 222/153 |
| 4,358,031 | 11/1982 | Lohrman | 222/153 |
| 4,368,830 | 1/1983 | Soughers | 222/321 |
| 4,565,302 | 1/1986 | Pfeiffer et al. | 222/153 |
| 4,566,611 | 1/1986 | Sukopp | 222/402.11 |
| 4,773,567 | 9/1988 | Stoody | 222/402.11 |

FOREIGN PATENT DOCUMENTS

| | | | |
|---|---|---|---|
| 2228165 | 8/1973 | Fed. Rep. of Germany . | |
| 2909948 | 9/1979 | Fed. Rep. of Germany . | |
| 2924735 | 1/1980 | Fed. Rep. of Germany . | |
| 2948862 | 8/1980 | Fed. Rep. of Germany . | |
| 8500025 | 4/1985 | Fed. Rep. of Germany . | |
| 3340869 | 5/1985 | Fed. Rep. of Germany . | |
| 2124711 | 2/1984 | United Kingdom | 222/321 |

*Primary Examiner*—H. Grant Skaggs

*Attorney, Agent, or Firm*—Steele, Gould & Fried

[57] ABSTRACT

A discharger, particularly intended for the discharge of flowable media, especially pharmaceutical preparations, has a lock for the discharge head (5) in the form of a pump handle, so that the latter cannot be operated in an accidental or unauthorized manner. For this purpose two release handles (24) are provided which must be simultaneously depressed, after which discharge head (5) can be turned with the other hand, so that locking members (22) of the lock do not jump back into their locking position and instead slide on a sliding surface (27) of discharge head (5) during operation. Following the use of discharger (1), discharge head (5) can be rotated back into a position in which the locking members (22) resiliently spring back into their locking position.

44 Claims, 1 Drawing Sheet

DISCHARGER FOR FLOWABLE MEDIA

This is a continuation of application Ser. No. 022,792, filed Mar. 6, 1987 now abandoned.

BACKGROUND OF THE INVENTION

1. Field of the Invention

The invention relates to a discharging apparatus or discharger for discharging flowable media from a vessel, with a manually pressure-operable discharge head having a discharge opening for discharge relative to a vessel-side support body, which is locked with a releasable locking means to prevent movements roughly parallel to a central axis out of its starting position and having cooperating locking members on the discharge head and support body.

2. Prior Art

The discharge head of such a discharge can, for example be locked in its starting position against accidental operating movements in that it is locked in one rotary position about the central axis and is unlocked in another. However, such a locking system is inadequate in those cases where it is necessary to prevent unauthorized use of the discharger, e.g., by children. Thus, when playing, a child can accidentally bring the discharge head and support body into an unlocked position with respect to one another and can then operate the discharge head so that, as a function of the characteristics of the medium being discharged, the child can be exposed to a more or less serious danger.

SUMMARY OF THE INVENTION

An object of the present invention is to provide a discharger of the indicated type, which in a simple manner provides high security against unauthorized operation of the discharge head.

According to the invention this can be achieved in simple manner in that the cooperating locking members are held together resiliently in reengageable engagement and can be disengaged counter to spring tension using a release handle. As soon as the locking members are freed or released again following an unlocking operation in order to operate the discharge head, under the spring action they jump back into their locking engagement, so that it is scarcely possible for people unacquainted with the use of the discharger to repeat operation.

It is particularly advantageous if the release handle or handles does not have to be held in the release position during the complete pressure operation of the discharge head, which can e.g. be achieved in that adjacent to a stop opening of one component is provided in the pressure operating direction a sliding surface for a stop member of the other component. In order that during the correct use of the discharger and when returning the discharge head into the initial position the locking system does not return to the locking engaged position, the discharge head and support body, other than in the pressure operation direction, in a further direction differing therefrom can be moved and in particular rotated with respect to one another into a position in which the two cooperating locking members are located on movement paths which are spaced from one another.

It has been found that an unlocking movement directed away from the central axis is more difficult for children to perform than an unlocking movement directed towards the central axis and which could be performed by simple radial pressure on the stop member. To further simplify the use of the discharger by people having a knowledge of the correct operation thereof, the release handle is constructed as a pushbutton, which is preferably provided at the end of a spring arm freely discharging counter to the pressure operating direction of the discharge head, so that it can be operated in the same direction as the pressure operation of the discharge head. Thus, while supporting the device with the thumb on the underside of the vessel, the release handle can be operated with further fingers of the same hand, the other hand then being necessary in a coordinated manner for rotating the discharge head with respect to the support body into the unlocking position. The fingers operating the release handle can then free the latter and be transferred to the immediately adjacent handle serving for the pressure operation of the discharge head.

If this discharge head handle is constructed in such a way that it covers the release handle at a limited spacing in the unlocking position, then on the one hand it is easily possible to recognise the unlocked state of the discharger and on the other hand a pressure loading or accidental operation of the release handle is precluded. In this case, even after relatively limited rotation,the discharge head is in an unlocking position such that the stop member cannot jump back into the stop opening and instead with part of its stop can, slides past the sliding surface, so that without further operation of the release handle, the discharge head can be transferred completely into the unlocking end position.

For ergonomic reasons, it is appropriate to provide two facing release handles which only release the locking system in the case of simultaneous operation and which are intended to act on a common locking member, but appropriately in each case act on a separate locking member and make it possible to support the hand in stable manner on a release handle using two fingers on either side of the discharger, so that the release handles can be made relatively small. This further increases the security against unauthorized use of the discharger.

The inventive construction, which is also suitable for dischargers of vessels which are under pressure, such as e.g. dischargers essentially only opening a valve through the pressure operation of the discharge head, is used with particular advantage on those dischargers having a discharge pump, which is operated with the discharge head and by pumping action delivers the medium out of the vessel through the discharge opening. Such dischargers are particularly used for pharmaceutical preparations, which must be particularly secure against unauthorized use by children.

These and other features of the preferred further developments of the invention can be gathered from the following description and drawings, whereby individual features can be realized in any embodiment of the invention and in other fields, either individually, or in the form of subcombinations.

BRIEF DESCRIPTION OF THE DRAWINGS

The invention is described in greater detail hereinafter relative to the drawings, wherein show.

DETAILED DESCRIPTION OF THE PREFERRED EMBODIMENTS

A relatively high rigidity is obtained through the circular arc-shaped construction of the spring arm 23, even in the case of very small wall thickness, e.g. in the range of 1 mm.

Figure 2:
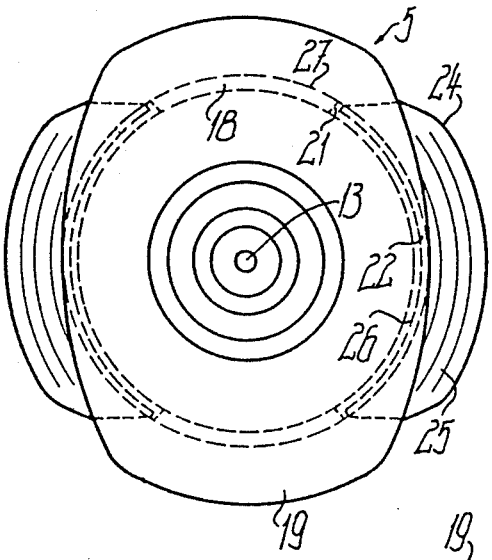
FIG. 2 The discharger according to FIG. 1 in plan view, but with the protective cap removed.
Figure 1:
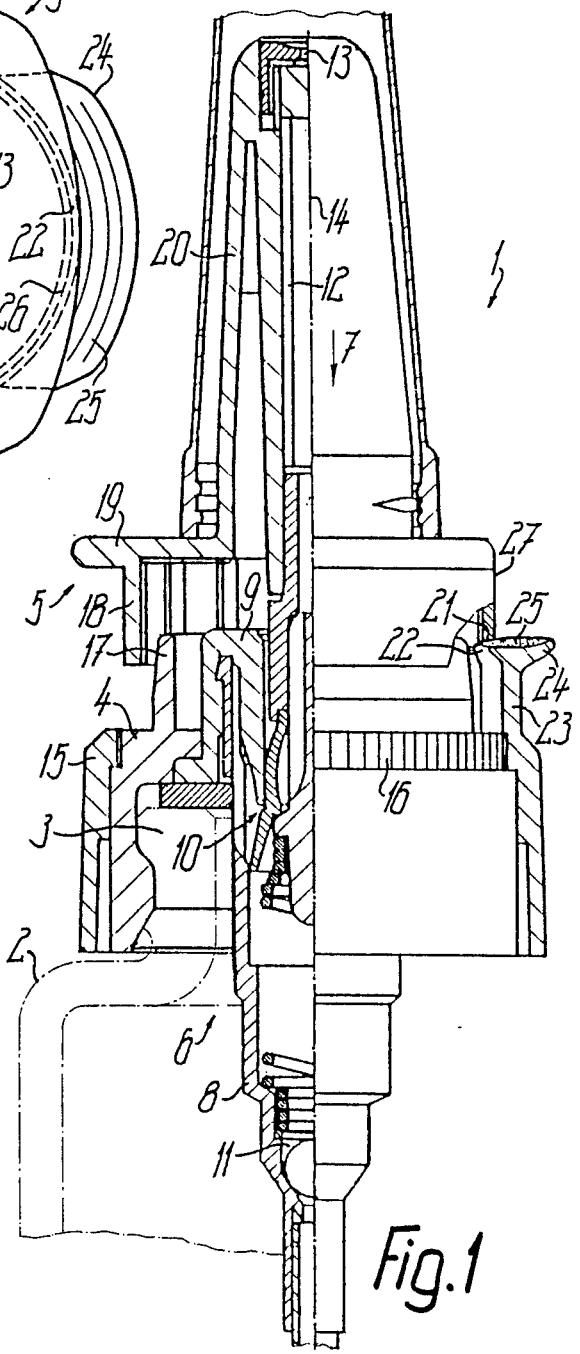
FIG. 1 An inventive discharger in axial section.

The discharger 1 according to FIGS. 1 and 2 is intended for the delivery of flowable, particularly liquid media from an e.g. bottle-shaped vessel, shown in dot-dash line form in FIG. 1 and to whose neck 3 is fixed discharger 1 with cap-shaped support body 4 in such a way that the neck opening of vessel 2 is tightly sealed and the support body 4 positively surrounds the outer circumference of vessel neck 3. At the side remote from vessel 2, discharger 1 has a discharge head 5 which, by depressing in the direction of arrow 7, makes it possible to operate a thrust piston pump 6 projecting into vessel 2 and coaxially fixed to support body 4. The thrust piston pump has a cylinder block 8 substantially symmetrical to the central axis 14 of discharger 1 and which is closed at a further end by a cylinder cover 9, which is fixed by support body 4 against the end face of vessel neck 3. A pump piston 10 is axially displaceably mounted in the cylinder block and its elastically crushable piston sleeve forms an outlet valve with a valve seat mechanically opening at one end of the pump stroke. After opening the outlet valve the medium under an overpressure in the pump chamber is discharged by an outlet channel provided in the piston body and continued in discharge head 5 through a discharge opening 13, e.g. constructed as an atomizer nozzle at the end, remote from vessel 2, of a socket-like shoulder of discharge head 5. During the return stroke by means of a dip tube provided at the inner end of cylinder block 8, medium is sucked out of vessel 2 into the thrust piston pump 6 for discharge during the next pump stroke by a check valve 11 opening in the case of an underpressure in the pump chamber.

On the outer circumference of support body 4 is mounted a cap 15 closely surrounding the same and which terminates in a roughly flush manner with the end of support body 4 facing vessel 2 and extends up to an external diameter-stepped external tooth system 16 of the support body, in which it engages in non-rotating manner by means of a corresponding internal tooth system. On the side facing vessel 2, the external tooth system 16 passes into a ring shoulder, on which cap 15 engages in axially secured manner with a corresponding internal shoulder. On the end of the external tooth system 16 remote from vessel 2 and with which part of the associated end face of cap 15 terminates is connected a projecting circumferential casing 17, which surrounds the cylinder cover and whose free end face is approximately in the plane of the outer end face of cylinder cover 9. The end face of the vessel neck 3 is located on the inside of the end wall of support body 4, whose outside is formed by the lastmentioned, outer end face.

Discharge head 5 is provided on its end facing support body 4 with a cylindrical casing 18, which surrounds the circumferential casing 17 on the outer circumference at a limited radial spacing, so that circumferential casing 17 is located, with radial spacing, between the cylinder cover 9 and casing 18. At the end remote from the support body 4, casing 18 passes into a pressure plate 19 constructed in one piece therewith and at right angles to the central axis 14 and which has a non-circular external shape, but which is centrally symmetrical with respect to the central axis 14. On two diametrically facing sides, pressure plate 19 projects over the outer circumference of casing 18, and on two diametrically facing sides at right angles thereto, namely the longitudinal sides thereof, extends just up to said outer circumference. The section through the projecting part of pressure plate 19 is located to the left of central axis 14 in FIG. 1, and to the right of central axis 14 it is placed through that part of pressure plate 19 which only extends up to the outer circumference of casing 18. On the side of pressure plate 19 remote from casing 18 is connected the discharge connection 20 receiving the discharge channel 12 and which cover over its entire circumference is set back with respect to pressure plate 19 in such a way that a finger of one hand can be supported on pressure plate 19 on either side of discharge connection 20, while the thumb of said hand for counter-support is appropriately placed on the bottom of vessel 2, so that in simple manner discharge head 5 can be moved in the direction of arrow 7 for performing the pump stroke counter to the tension of a return spring against vessel 2 provided in the thrust piston pump 6. Discharge head 5, connected in non-rotary manner with pump piston 10, can be rotated about central axis 14 with respect to support body 4 and cylinder block 8 because pump piston 10 is guided in rotary manner in cylinder block 8.

On its free end face remote from pressure plate 19, casing 18 of discharge head 5 has two diametrically facing, identical and mirror-symmetrically arranged stop openings 21 in the form of constant depth cutouts in the associated end face and extending in each case over a relatively large arc angle. With each stop opening 21 is associated a cam-like stop member 22, which can also be given a corresponding circular arc-like construction and appropriately only engages in stop opening 21 over part of the thickness of casing 18. The stop member is constructed as a projection of a spring arm 23 directed radially from central axis 14 and which in the same way as stop member 22 is curved in ring cutout-like manner around central axis 14 and is constructed in one piece with cap 15. Spring arm 23, cross-sectionally parallel to central axis 14 and with radial spacing adjacent to circumferential casing 17, projects linearly over the associated end face of the external tooth system 16 or the associated end face of cap 15. The spring arm is slightly radially offset with respect to the external circumference of cap 15 and is dimensioned in such a way that it permits a radially outwardly directed movement of stop member 22 against the springs tension inherent therein until stop member 22 is out of engagement with stop opening 21, i.e. outside the external circumference of casing 18. For releasing stop member 22 a release handle 24 is provided on spring arm 23, which projects radially outwards over the outer circumference of spring arm 23 and with stop member 22 forms a cross-sectionally widened portion at the free end of spring arm 23. The free end face of this widened portion is constructed as a recessed part 25, which extends radially relative to central axis 14 approximately from the edge of the stop member 22, provided as a bearing face 26 and located closest to the central axis 14, to the circumferential edge of release handle 24 radially most remote from central axis 14. This outer edge of the release handle 24, which is in locking engagement, is located on the same circular arc as the convexly outwardly curved narrow sides of pressure plate 19, whose longitudinal sides are also convexly outwardly curved with a larger radius of curvature and pass via rounded portions into the narrow sides. The width of release handle 24 in the circumferential direction of discharger 1 is at the most as large as the width of pressure plate 19 in the vicinity of its narrow sides, so that the two release handles 24 in a position of the discharge head 5 turned by 90° compared with FIG. 2 are covered in congruent manner by pressure plate 19 and consequently as a result of the very small clearance between said plate and the release handles are no longer accessible for operation purposes.

The stop openings 21 extend over an arc angle about the central axis 14, which is only slightly larger or only larger by the necessary movement clearance than the corresponding arc angle of stop members 22. If the stop members 22 are moved radially outwards out of engagement from stop openings 21 by finger pressure against the recessed parts 25 under flexible resilience of spring arms 23 and if the discharge head 5 is then turned by a small amount about the central axis 14, then the associated arc end of stop member 22, even on releasing handle 24, can no longer return into stop opening 21 and instead engages on the outer circumferential surface of casing 18, which then forms a sliding surface 27 for the bearing surface 26 of the particular stop member 22. Thus, without further operation of release handles 24, discharge head 5 can turn further into the position covering release handles 24. On further turning or turning back from this unlocked position, the particular stop member 22 with the associated arc end again returns into the vicinity of the stop opening and this arc end not then supported by sliding surface 27, can migrate so far radially inwards under the spring action of spring arm 23 that during said rotary movement it strikes against the associated lateral boundary of the stop opening 21. Thus, it is substantially impossible for any movement to occur past the stop position or a jumping over the stop opening 21 on the part of stop member 22, and the locking position can be very easily found. Release handle 24 or recessed part 25 is connected directly to the outer circumference of casing 18, so that the finger operating handle 24 can be kept reliably engaged with the latter through additional support on said external circumferential surface, even when handle 24 has a relatively narrow construction.

To adapt to spring arm 23 to its materials and cross-sections, it is also possible to provide on its inner and/or outer circumferential surface in the transition zone into the cap a notch, through which its cross-section is reduced over all or part of its arc extension in the manner of a desired bending point or in film hinge-like manner. In addition, cuts can be made on one or both arc ends in said transition area, so that the spring arm is completely separated from the cap in the particular area.

The inventive construction leads to a very compact arrangement of the locking means, which can be obtained with substantially no additional parts. It is also possible to construct the stop members 22 in one part with the support member 4. It is also conceivable to provide stop member 22 on discharge head 5 and the stop opening on the support member.

I claim:

1. A discharger for discharging flowable media from a vessel, comprising:

a discharge head having a discharge opening and a support body for connection with a medium container, said discharge head for discharge purposes being manually operable via movement of an operating face in an operating direction from an initial position with respect to said support body;

a manually releasable locking system for said discharge head, lockable to prevent movement from the initial position in the operating direction;

locking means of said locking system having cooperating disengageable locking members on associated components provided by the discharge head and the support body, said cooperating locking members being resiliently held together in re-engageable self-locking engagement in a locking position and being disengageable into an unlocking position counter to spring tension by at least one release handle providing an operationally accessible actuating face for a user's finger, said release handle being manually operable only by a manual engagement separate from a manual engagement for operating said discharge head, said release handle being located apart from said operating face of the discharge head for manually separately releasing the locking system by manually urging said actuating face of said release handle, means being provided for holding said cooperating locking members in an unlocking position in their initial position upon relative displacement with respect to one another and for relocking under spring tension in said initial position upon relative re-displacement, and wherein on a widened portion said release handle has said actuating face, provided by a recessed part, said widened portion forming one of said locking members and said release handle as a part of a spring arm providing said spring tension.

2. The discharger according to claim 1, wherein the cooperating disengageable locking members are in a form of at least one stop member and at least one stop opening for receiving an associated stop member in the locking position, each provided on one of the associated components.

3. The discharger according to claim 2, wherein in a direction corresponding to said operating direction axially adjacent to said at least one stop opening on one of the associated components is provided a sliding surface for said stop member, said sliding surface defining said outer circumferential face.

4. The discharger according to claim 2, wherein circumferentially adjacent to the at least one stop opening on one of the associated components is provided a sliding surface for said at least one stop member, said sliding surface defining said outer circumferential face.

5. The discharger according to claim 2, wherein a sliding surface for said at least one stop member is curved in substantially cylindrical casing-like manner about a central axis of said discharger.

6. The discharger according to claim 2, wherein said at least one stop member has a stop cam.

7. The discharger according to claim 6, wherein said stop cam of the at least one stop member is directed against a central axis of said discharger.

8. The discharger according to claim 6, wherein said stop cam has an inwardly-facing edge-like circumferential bearing face for engaging said sliding surface.

9. The discharger according to claim 6, wherein said stop cam has a linear bearing face for engaging said sliding surface.

10. The discharger according to claim 2, wherein said at least one stop member is arranged on a spring arm.

11. The discharger according to claim 10, wherein said spring arm is constructed integrally in one piece with one of said associated components.

12. The discharger according to claim 10, wherein said spring arm in axial cross-section projects substantially parallel to a central axis of said discharger.

13. The discharger according to claim 12, wherein said at least one release handle is constructed as a push button on a free end of said spring arm providing an operating face for a user's finger engagement located transverse to said central axis of said discharger.

14. The discharger according to claim 10, wherein the spring arm is curved in a partial ring shape substantially around a central axis of said discharger.

15. The discharger according to claim 10, wherein said spring arm forms an axial extension of a casing of one of said associated components.

16. The discharger according to claim 10, wherein said spring arm projects freely counter to said operating direction of said discharge head.

17. The discharger according to claim 2, wherein said at least one stop opening is constructed as a slot-like cutout in a free end face of a casing located substantially coaxial with a central axis of said discharger and with one of said associated components.

18. The discharger according to claim 17, wherein an external circumferential surface of said casing forms at least one sliding surface for said at least one stop member, said at least one release handle being located directly adjacent to said at least one sliding surface.

19. The discharger according to claim 2, wherein said at least one stop member is provided on said support body, said stop member being movably mounted between said locking and said unlocking positions, said support body being provided for mounting said discharger on a vessel.

20. The discharger according to claim 2, wherein said at least one stop member having said operationally accessible release handle is provided on an outer jacket of a cap receiving said support body.

21. The discharger according to claim 20, wherein said cap is prevented from turning with respect to said support body by means of an internal tooth system engaging in an external tooth system of said support body.

22. The discharger according to claim 1, wherein the locking members are movable with respect to one another substantially radially to the operating direction into a disengaging position defining said unlocking position.

23. The discharger according to claim 1, wherein said at least one release handle is provided on said support body, said support body being provided for mounting said discharger on a vessel.

24. The discharger according to claim 1, wherein said support body is formed by a vessel cap mounting said discharge head.

25. The discharger according to claim 1, wherein for manual operation said discharge head has a pressure plate substantially at an angle to said operating direction and spaced in said operating direction from said discharge opening of said discharge head, said pressure plate being located adjacent to said locking means.

26. The discharger according to claim 25, wherein at least one release handle of said locking means is displaced in position from said pressure plate in a direction corresponding to said operating direction of said discharge head.

27. The discharger according to claim 25, wherein said pressure plate defines a peripheral shape as viewed in a direction parallel to said operating direction of said discharge head which shape is non-circular, said pressure plate and said at least one release handle being displaceable with respect to one another such that the pressure plate provides means substantially covering said at least one release handle in a held unlocking position not released by returning the discharge head to said initial position and uncovering said at least one release handle in positions reached by said re-displacement towards said relockable position.

28. The discharger according to claim 27, wherein at least one sliding surface of a casing of said discharge head has at least one stop opening for receiving at least one stop member of said locking means, the at least one sliding surface being connected directly to one side of said pressure plate, said sliding surface being provided for slidingly receiving said stop member in said held unlocking position.

29. The discharger according to claim 27, wherein said pressure plate has two opposite remote sides, at least one sliding surface for at least one stop member of said locking means extending substantially up to an outer boundary of said pressure plate in the vicinity of an associated one of said two remote sides.

30. The discharger according to claim 27, wherein said pressure plate has an elongated rectangular basic shape.

31. The discharger according to claim 27, wherein said pressure plate has convexly outwardly curved outer edges leading in rounded manner into one another.

32. The discharger according to claim 27, wherein at least one radially projecting end of said pressure plate in said held unlocking position is substantially congruent to said at least one release handle as viewed along the operating direction, the radially projecting end and the release handle having substantially a same radially projecting outer contour.

33. The discharger according to claim 1, wherein on said support body is provided a thrust piston pump having a pump piston operationally connected to said discharge head.

34. The discharger according to claim 33, wherein said thrust piston pump has a cylinder block, said locking members being located radially adjacent to an outer end of said cylinder block.

35. The discharger according to claim 1, wherein an operational release movement of said actuating face of said at least one release handle for manually disengaging said cooperating locking members is directed substantially radially outwards with respect to a central axis of said discharger.

36. The discharger according to claim 1, wherein a locking member operationally connected to said release handle protrudes radially inwardly from said spring arm and said release handle protrudes radially outwardly from said spring arm with respect to a central axis of the discharger.

37. The discharger according to claim 1, wherein said at least one release handle is connected to said locking member to be operated by said release handle located substantially radially adjacent to said locking member with respect to a longitudinal axis of an arm bearing said release handle and said locking member, said at least one release handle being movably mounted transverse to said longitudinal axis, said actuating face being an end face of said arm.

38. A discharger for discharging flowable media from a vessel, comprising:

a discharge head having a discharge opening and a support body for connection with a medium container, said discharge head for discharge purposes being manually operable via movement of an operating face in an operating direction from an initial position with respect to said support body;

a manually releasable locking system for said discharge head, lockable to prevent movement from the initial position in the operating direction;

components provided by the discharge head and the support body defining cooperating locking members resiliently held together in re-engageable self-locking engagement in a locking position and being disengageable into an unlocking position counter to spring tension by two facing release handles operationally accessible by a user's fingers, said release handles being manually operable only by a manual engagement separate from a manual engagement for operating said discharge head for discharge purposes, said release handles being located apart from said operating face of the discharge head for manually separately releasing the locking system, and wherein said release handles are manually movable away from an external outer circumferential face of said discharger for releasing said locking means, said two facing release handles releasing the locking means only with simultaneous operation of both the two facing release handles.

39. The discharger according to claim 38, wherein said release handles are provided for separate locking members.

40. A discharger for discharging flowable media from a vessel, comprising:

a discharge head having a discharge opening and a support body for connection with a medium container, said discharge head for discharge purposes being manually operable via movement of an operating face in an operating direction from an initial position with respect to said support body;

a manually releasable locking system for said discharge head, lockable to prevent movement from the initial position in the operating direction;

components provided by the discharge head and the support body defining cooperating locking members resiliently held together in re-engageable self-locking engagement in a locking position and being disengageable into an unlocking position counter to spring tension by at least one release handle operationally accessible by a user's fingers, said release handle being manually operable only by a manual engagement separate from a manual engagement for operating said discharge head for discharge purposes, said release handle being located apart from said operating face of the discharge head for manually separately releasing the locking system, and wherein said at least one release handle is manually movable away from an external outer circumferential face of said discharger for releasing said locking means, means being provided for holding said cooperating locking members in said unlocking position upon relative displacement with respect to one another, thereby providing a held unlocking position, said means being provided for permitting spring-tensioned relocking of said cooperating locking members in said initial position upon relative re-displacement.

41. The discharger according to claim 40, wherein for providing said means for holding, the discharge head and the support body are rotatable with respect to each other into said held unlocking position, in which the initial position of the discharge head and the cooperating locking members are out of engagement, these cooperating locking members being mounted for displacement with respect to one another about a central axis of the discharger.

42. The discharger according to claim 40, further comprising a displacing handle for displacing said cooperating locking members between said held unlocking position and said relockable position, said displacing handle being a handle separate from said at least one release handle.

43. The discharger according to claim 42, wherein said displacing handle is arranged on one of said associated components and said at least one release handle is arranged on an other of said associated components.

44. The discharger according to claim 40, wherein a pressure plate providing said operating face has a shape as viewed in a direction parallel to said operating direction of said discharge head which shape is non-circular, whereby the pressure plate provides means substantially covering said at least one release handle in said held unlocking position and uncovering said at least one release handle upon relative re-displacement towards said relockable position.

* * * * *